US011002124B2

(12) United States Patent
Kumar

(10) Patent No.: US 11,002,124 B2
(45) Date of Patent: May 11, 2021

(54) DOWNHOLE DEVICE AND DOWNHOLE SYSTEM

(71) Applicant: WELLTEC A/S, Allerød (DK)

(72) Inventor: Satish Kumar, Allerød (DK)

(73) Assignee: WELLTEC A/S, Allerød (DK)

( * ) Notice: Subject to any disclaimer, the term of this patent is extended or adjusted under 35 U.S.C. 154(b) by 529 days.

(21) Appl. No.: 15/428,451

(22) Filed: Feb. 9, 2017

(65) Prior Publication Data

US 2017/0226837 A1 Aug. 10, 2017

(30) Foreign Application Priority Data

Feb. 10, 2016 (EP) ..... 16155044

(51) Int. Cl.
*E21B 43/26* (2006.01)
*E21B 23/02* (2006.01)
(Continued)

(52) U.S. Cl.
CPC ..... *E21B 43/26* (2013.01); *E21B 23/01* (2013.01); *E21B 23/02* (2013.01);
(Continued)

(58) Field of Classification Search
CPC ..... E21B 43/26; E21B 23/01; E21B 23/02; E21B 34/14; E21B 2034/007
(Continued)

(56) References Cited

U.S. PATENT DOCUMENTS 4,295,528 A * 10/1981 Carmody ..... E21B 23/02 166/217
4,558,751 A 12/1985 Huffaker
(Continued)

FOREIGN PATENT DOCUMENTS

EP 2 728 108 5/2014
RU 2 302 509 C2 7/2007
(Continued)

OTHER PUBLICATIONS

Decision on Patent Grant for Invention dated Jun. 18, 2020 in Russian Application No. 2018130873/03(050271), with English translation, 18 pages.

*Primary Examiner* — Matthew Troutman
*Assistant Examiner* — Patrick F Lambe
(74) *Attorney, Agent, or Firm* — Nixon & Vanderhye P.C.

(57) ABSTRACT

The present invention relates to a downhole device for being moved downwards in a well by fluid to assist stimulation of a production zone of the well, the well comprising a well tubular structure having a first opening and a first movable sleeve arranged opposite the first opening, and the well tubular structure having an inner diameter, the downhole device having an axial extension, and comprising: a first part comprising two projection elements having a profile matching grooves in the sleeve, and a second part comprising: a body, two anchor elements projectable from the body for anchoring the second part in the well tubular structure, and a sealing element configured to seal against the well tubular structure, the downhole device further comprising: a displacement mechanism comprising a piston movable within a piston cylinder to displace, in the axial extension, the first part in relation to the second part when anchored in the well tubular structure to operate the sleeve. The invention also relates to a downhole system for stimulating a formation surrounding a well tubular structure of a well. Finally, the present invention relates to a stimulation method for stimulating a formation by means of a downhole system according to the invention.

16 Claims, 18 Drawing Sheets

(51) Int. Cl.
*E21B 23/01* (2006.01)
*E21B 33/1295* (2006.01)
*E21B 34/14* (2006.01)

(52) U.S. Cl.
CPC ..... *E21B 33/1295* (2013.01); *E21B 34/14* (2013.01); *E21B 2200/06* (2020.05)

(58) Field of Classification Search
USPC ..... 166/305.1
See application file for complete search history.

(56) References Cited

U.S. PATENT DOCUMENTS

| | | | |
|---|---|---|---|
| 7,353,871 | B2 | 4/2008 | Hromas et al. |
| 7,392,851 | B2 | 7/2008 | Brennan, III et al. |
| 2015/0176388 | A1 | 6/2015 | Tolman et al. |

FOREIGN PATENT DOCUMENTS

| | | | | |
|---|---|---|---|---|
| RU | 2 384 692 | C2 | 3/2010 | |
| SU | 945364 | A1 | 7/1982 | |
| WO | WO 2015/160342 | | 10/2015 | |
| WO | WO 2015/197532 | | 12/2015 | |
| WO | WO-2015197532 | A1 * | 12/2015 | ..... E21B 23/00 |

* cited by examiner

DOWNHOLE DEVICE AND DOWNHOLE SYSTEM

This application claims priority to EP Patent Application No. 16155044.7 filed Feb. 10, 2016, the entire content of which is hereby incorporated by reference.

FIELD OF THE INVENTION

The present invention relates to a downhole device for being moved downwards in a well by fluid to assist stimulation of a production zone of the well. The invention also relates to a downhole system for stimulating a formation surrounding a well tubular structure of a well. Finally, the present invention relates to a stimulation method for stimulating a formation by means of a downhole system according to the invention.

BACKGROUND ART

When stimulating production zones in wells, a first ball is dropped into the well and flows with the well fluid until it reaches a ball seat which it is not able to pass, causing the ball to seat in the ball seat of a first sleeve. A continuous pumping of fluid into the well results in a pressure on the ball moving the sleeve from a closed position to an open position. As the sleeve opens, the fluid enters the formation surrounding the well, and the stimulation process can begin. A second production zone is stimulated by dropping a second ball which is larger than the first ball, which second ball flows in the fluid until it reaches a ball seat in another sleeve positioned closer to the top of the well than the first sleeve. The second ball seats in the ball seat of the second sleeve, the sleeve is forced open, and the stimulation process of the second production zone can begin. In this way, multiple balls can be dropped to stimulate multiple sections of the well.

When the stimulation of the production zones has ended, an operation tool is submerged into the well to retrieve the ball seated in the sleeve closest to the surface, e.g. by drilling a hole in the ball. The operation tool is then retracted from the well, and in a second run, submerged into the well again to retrieve the next ball. The retrieval process is continued until all the balls have been retrieved, and oil production can be initiated by reopening all the sleeves.

Using this ball dropping process is inexpensive, but also very time-consuming since the balls have to be retrieved one by one. Furthermore, retrieving a round ball rolling in a ball seat can be very difficult, and the retrieval process may therefore fail.

SUMMARY OF THE INVENTION

It is an object of the present invention to wholly or partly overcome the above disadvantages and drawbacks of the prior art. More specifically, it is an object to provide an improved way of stimulating several production zones in a faster and more reliable way than with prior art solutions.

The above objects, together with numerous other objects, advantages and features, which will become evident from the below description, are accomplished by a solution in accordance with the present invention by a downhole device for being moved downwards in a well by fluid to assist stimulation of a production zone of the well, the well comprising a well tubular structure having a first opening and a first movable sleeve arranged opposite the first opening, the well tubular structure having an inner diameter, the downhole device having an axial extension and comprising:

- a first part comprising:
  - two projection elements having a profile matching grooves in the sleeve, and
- a second part comprising:
  - a body,
  - two anchor elements projectable from the body for anchoring the second part in the well tubular structure, and
  - a sealing element configured to seal against the well tubular structure, wherein the downhole device further comprises a displacement mechanism comprising a piston movable within a piston cylinder to displace, in the axial extension, the first part in relation to the second part when anchored in the well tubular structure to operate the sleeve.

In one embodiment, the displacement mechanism may comprise a spring being compressed during movement of the piston in relation to the piston cylinder.

In another embodiment, the sealing element may be a cup seal.

Furthermore, each projection element may be movable in a radial direction in and out of a projection cylinder.

Moreover, the projection cylinder may be fluidly connected with the piston cylinder so that fluid in the piston cylinder forces the projection element out of the projection cylinder upon movement of the piston in the piston cylinder.

The piston may have a first piston end extending into the piston cylinder, the first piston end having a face area, and the first part may have a first end and a second end being connected to the second part, and the first end may have a surface area being larger than the face area of the piston so that pressurised fluid in the well tubular structure forces the piston further into the piston cylinder.

Further, each anchor element may be movable in a radial direction in and out of an anchor cylinder.

The downhole device according to the invention may further comprise a pump adapted to provide pressurised fluid to the anchor cylinder and/or the projection cylinder to project the anchor elements and/or projection elements, respectively.

In one embodiment, the displacement mechanism may comprise a hydraulic accumulator.

In another embodiment, the second part may comprise a pump configured to be driven by a motor.

Additionally, the downhole device may comprise a power supply.

The power supply mentioned above may comprise a battery or a propeller driving a turbine driving a generator.

The downhole device of the present invention may further comprise an anchor activation cylinder, the anchor cylinder being fluidly connected with the anchor activation cylinder so that fluid in the anchor activation cylinder forces the anchor element out of the anchor cylinder upon movement of an activation piston into the anchor activation cylinder.

In one embodiment, a second spring may be arranged in the anchor activation cylinder.

In another embodiment, the activation piston may be moved into the anchor activation cylinder by pressurised fluid from the well tubular structure or the pump.

In yet another embodiment, the second part may comprise a protrusion projecting radially from the body.

The protrusion may be configured to be projectable.

In addition, the downhole device may comprise a positioning tool configured to determine a position of the downhole device along the well tubular structure.

Also, the downhole device may comprise one or more centraliser(s).

The downhole device may furthermore comprise a control unit configured to control the movement of the projection elements and/or the anchor elements.

The control unit mentioned above may comprise a timer, a sensor, a logging tool, a storage unit and/or a valve.

In one embodiment, the sensor may be a temperature sensor or a pressure sensor.

In another embodiment, the valve may be a sequential valve.

The downhole device of the present invention may have a leading end, the leading end being tapered or hemisphere-shaped.

The downhole device may further comprise a compensator being in fluid communication with the piston cylinder or anchor activation cylinder.

The invention also relates to a downhole system for stimulating a formation surrounding a well tubular structure of a well, the well having a top, comprising:

- a well tubular structure comprising:
  - at least two openings for allowing fluid to flow into and/or out of the well tubular structure,
  - at least a first movable sleeve and a second movable sleeve, each movable sleeve being arranged opposite one of the openings in a first position and uncovering the openings in a second position, and each movable sleeve having at least one groove,
- a system pump configured to pressurise the well tubular structure, and
- a downhole device as described above.

The downhole system described above may comprise a first and a second annular barrier configured to isolate a zone to be stimulated, each annular barrier comprising:

- a base tubular part for being mounted as part of the well tubular structure, the base tubular part comprising an aperture,
- an expandable sleeve surrounding the base tubular part and having an inner face facing the base tubular part and an outer face facing a wall of a borehole,
- each end of the expandable sleeve being connected with the base tubular part, and
- an annular space between the inner face of the expandable sleeve and the base tubular part.

In one embodiment the sealing element may be arranged further away from the top of the well than the movable sleeve.

In another embodiment, the aperture of the base tubular part may be arranged closer to the top of the well than the sealing element.

In yet another embodiment, the well tubular structure may have a projection positioned below each movable sleeve for engagement with the protrusion.

The well tubular structure may also have a recess configured to receive the anchor element.

Additionally, the well tubular structure may have one or more inflow section(s).

The inflow section(s) mentioned above may have a production opening.

Also, a production valve may be arranged in the production opening.

In addition, the downhole system may comprise a first and a second downhole device.

Furthermore, the first downhole device may be configured to open several sleeves, and the second downhole device may be configured to close the same sleeves again.

The opening opposite the sleeve may comprise a burst disc.

Finally, the present invention relates to a stimulation method for stimulating a formation by means of a downhole system according to the invention, comprising:

- submerging the downhole device described above in the well tubular structure,
- pressurising the well tubular structure,
- moving the downhole device along the well tubular structure,
- positioning the first part of the downhole device opposite the first movable sleeve,
- engaging the groove of the first movable sleeve by means of the projection element,
- anchoring the anchor elements in the well tubular structure,
- moving the first part in relation to the second part in a first direction, the first movable sleeve thereby uncovering the opening,
- stimulating the formation by injecting fluid out of the opening,
- moving the first part in relation to the second part in a second direction opposite the first direction thereby closing the opening,
- releasing the projection elements and anchor elements,
- moving the downhole device along the well tubular structure,
- positioning the first part of the downhole device opposite the second movable sleeve, and
- engaging the groove of the second movable sleeve by means of the projecting element.

Moving the first part in relation to the second part described above may be performed by pressurised fluid pressing the first part towards the second part in the first direction.

In one embodiment, the first part may be moved away from the second part by means of a compressed spring.

In another embodiment, the movement of the first part in relation to the second part may compress a spring.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
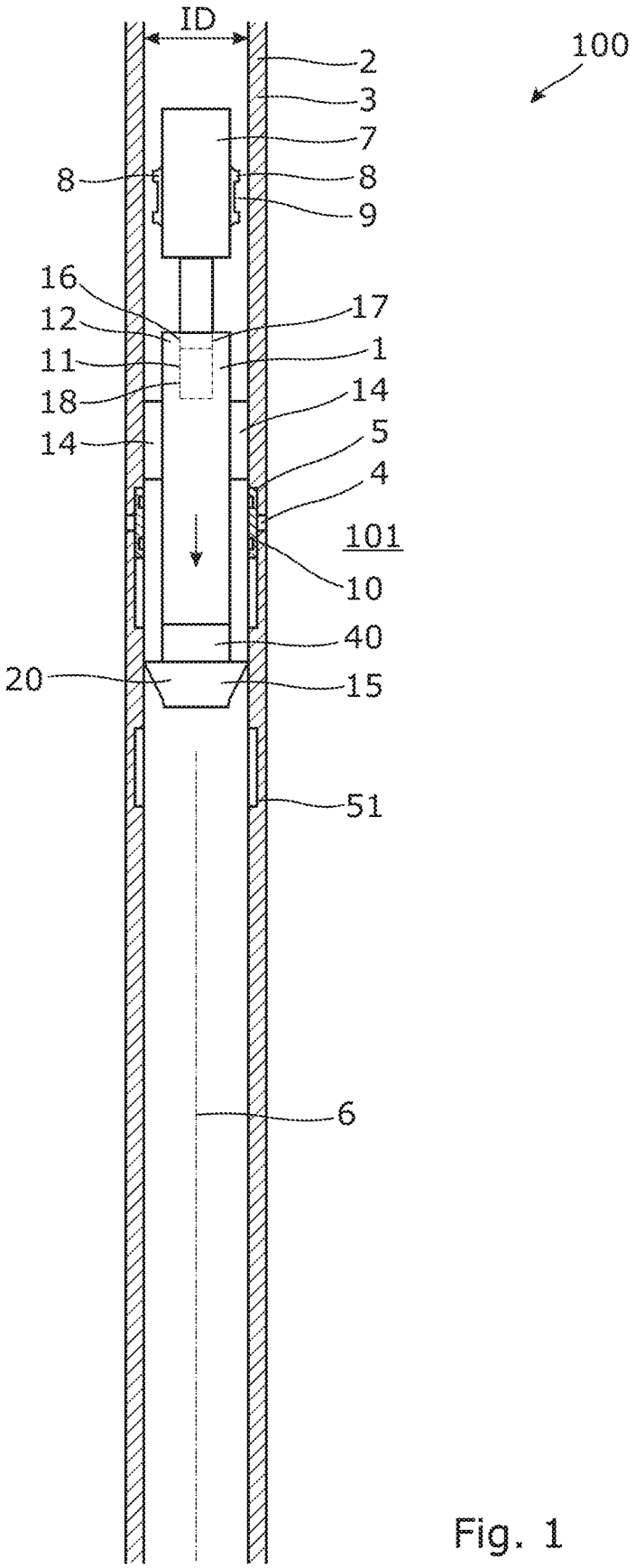
FIG. 1 shows a downhole device of a downhole system moving in a well for stimulating a surrounding formation.

FIG. 1 shows a downhole device 1 moving downwards in a well 2 by means of fluid flowing down the well, thereby pressing the downhole device 1 down a well tubular structure 3 in the well. The downhole device 1 is used for assisting stimulation of a production zone 101 of the well by ejecting fluid out through a first opening 4 of the well tubular structure 3 having a first sleeve 5 arranged opposite the first opening. The sleeve 5 is opened to eject stimulation fluid out of the opening and closed again to pressurise the well tubular structure again when ejecting fluid out through another opening.

The downhole device 1 comprises a first part 7 comprising two projection elements 8 having a profile 9 matching grooves 10 in the sleeve 5, and a second part 11 comprising a body 12, two anchor elements 14 projectable from the body for anchoring the second part in the well tubular structure, and a sealing element 15 configured to seal against the well tubular structure 3 in order to pressurise the inside of the well tubular structure above the sealing element and thus eject fluid out through the opening 4 to fracture the formation surrounding the opening in the well tubular structure. The downhole device 1 further comprises a displacement mechanism 16 comprising a piston 17 movable within a piston cylinder 18 to displace, in the axial extension, the first part 7 in relation to the second part 11 when anchored in the well tubular structure 3 to operate the sleeve 5.

Figure 2:
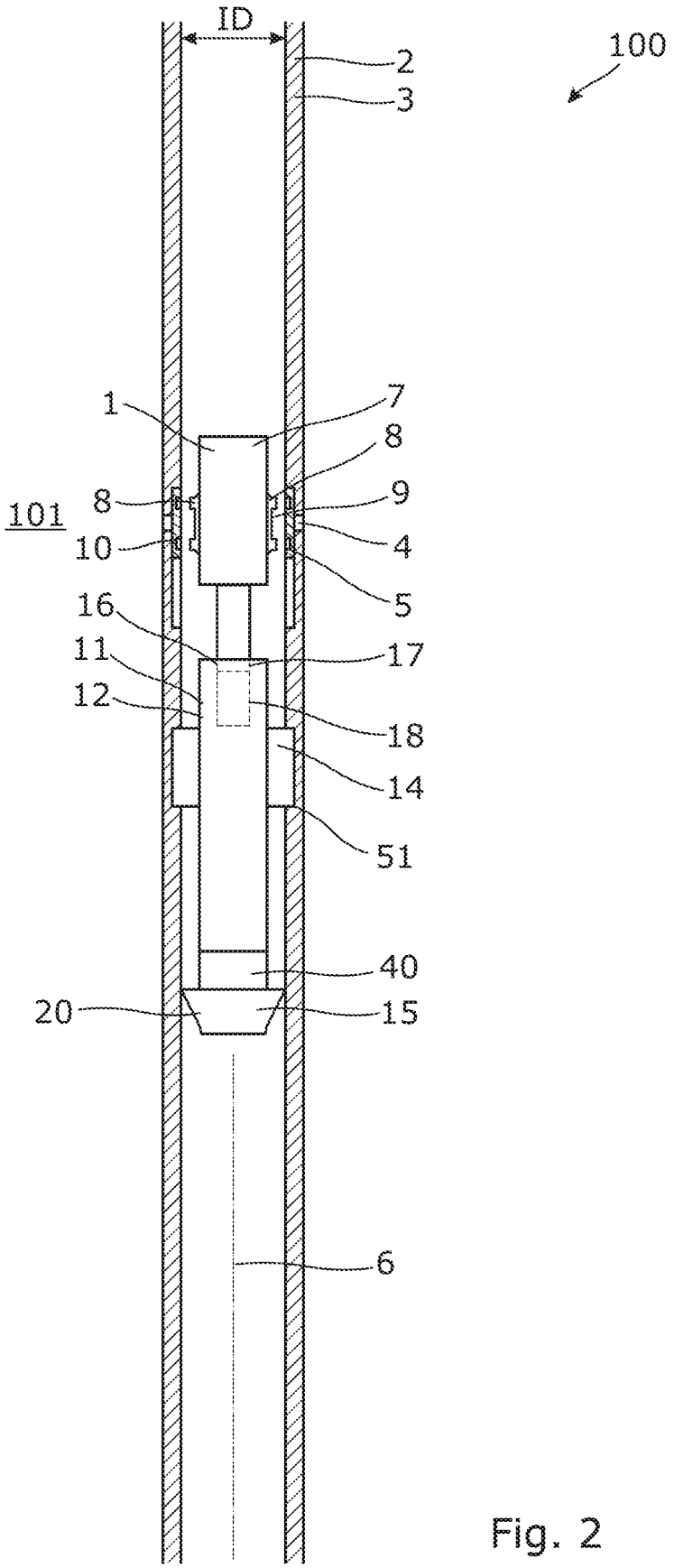
FIG. 2 shows the downhole device of FIG. 1 with projected anchor elements.

In FIG. 1, the downhole device 1 moves down the well with projected anchor elements 14 ready to dock into a recess 51 in the well tubular structure 3 configured to receive the anchor element 14. The downhole device 1 comprises a positioning tool 40 configured to determine a position of the downhole device 1 along the well tubular structure 3. When the positioning tool 40 has detected that the downhole device 1 is approaching the sleeve to be operated, the anchor elements are projected and slide along the well tubular structure until they are able to engage a cavity in the well tubular structure, and since the groove in which the sleeve 5 moves is too small, the anchor elements are not able to engage this groove and slide further down until they reach the recess 51 into which the anchor elements fit, as shown in FIG. 2.

Figure 3:
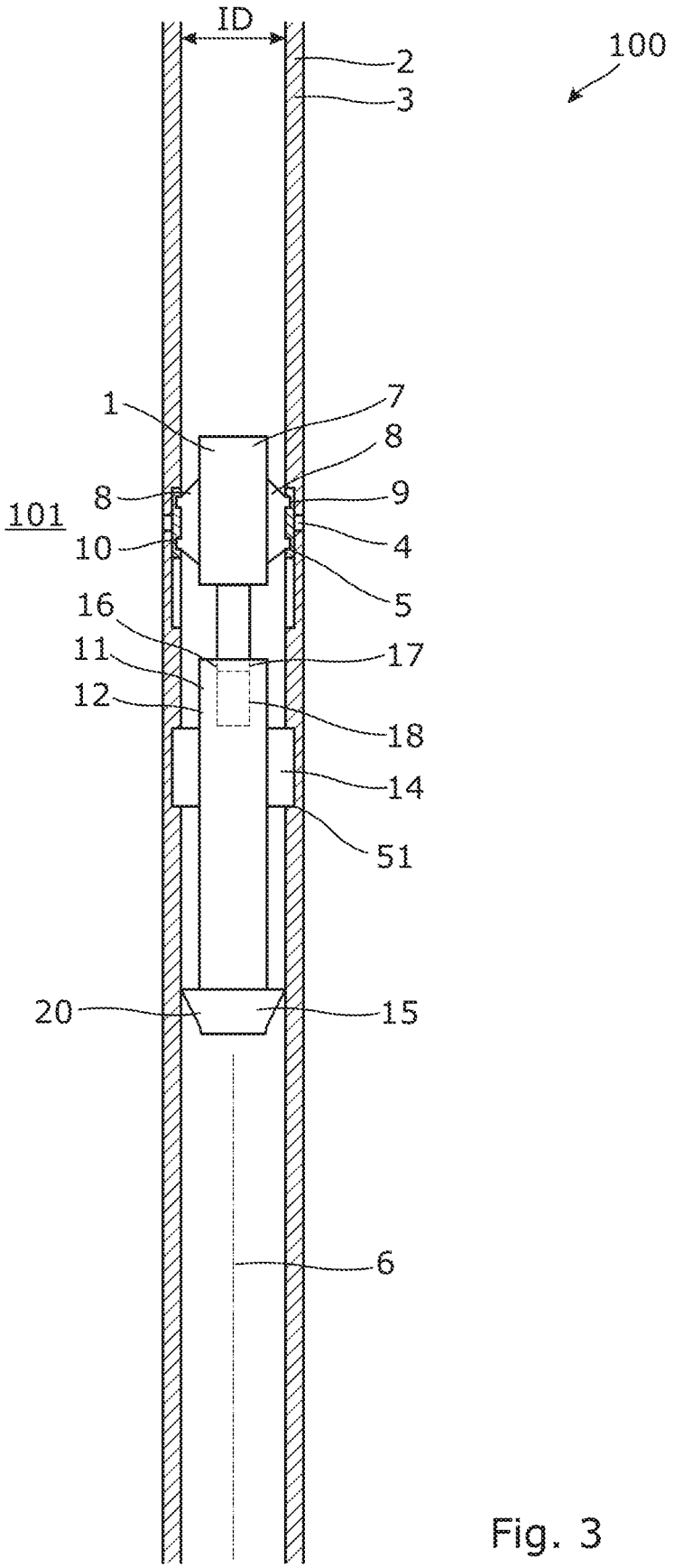
FIG. 3 shows the downhole device of FIG. 1 with projected projection elements before opening the sleeve.
Figure 4:
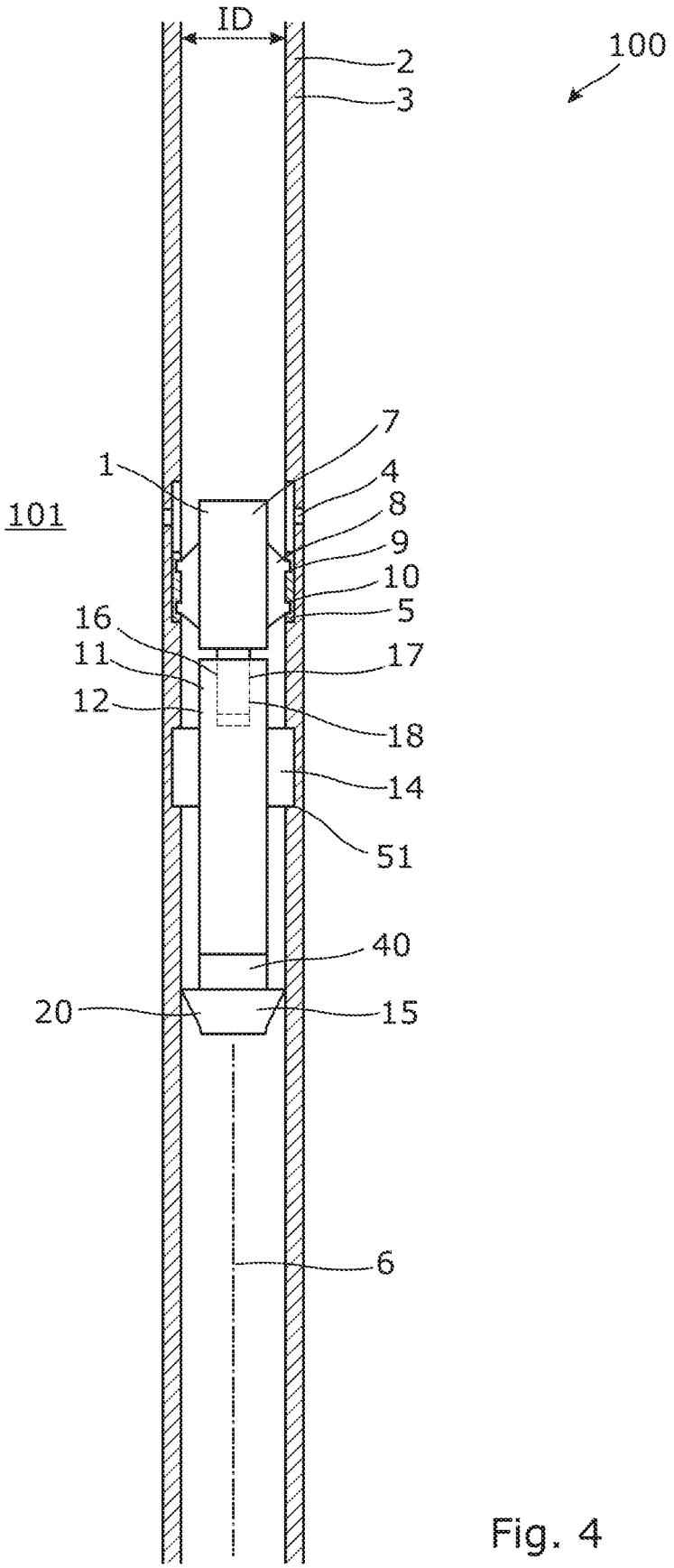
FIG. 4 shows the downhole device of FIG. 1 in which the sleeve is in the open position.
Figure 5:
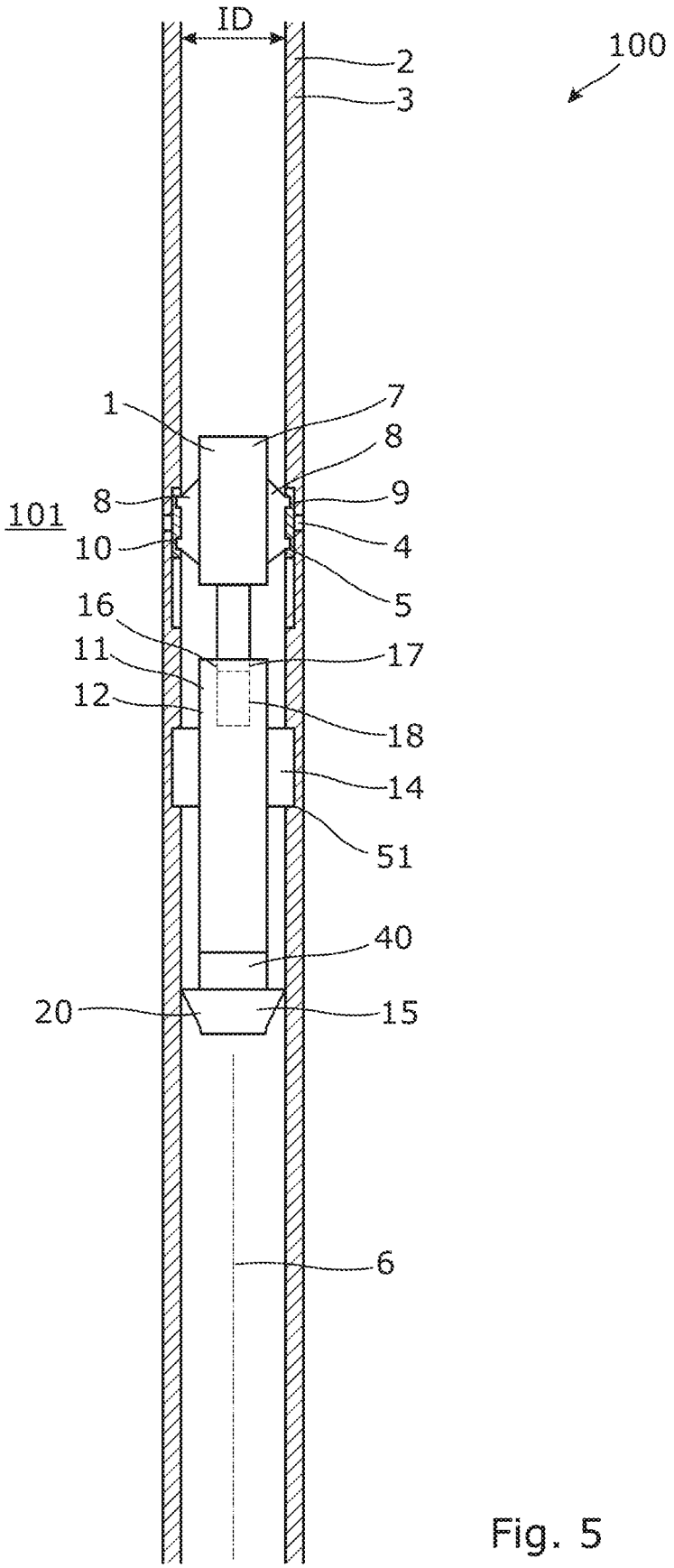
FIG. 5 shows the downhole device of FIG. 1 in which the sleeve is in the closed position.
Figure 6:
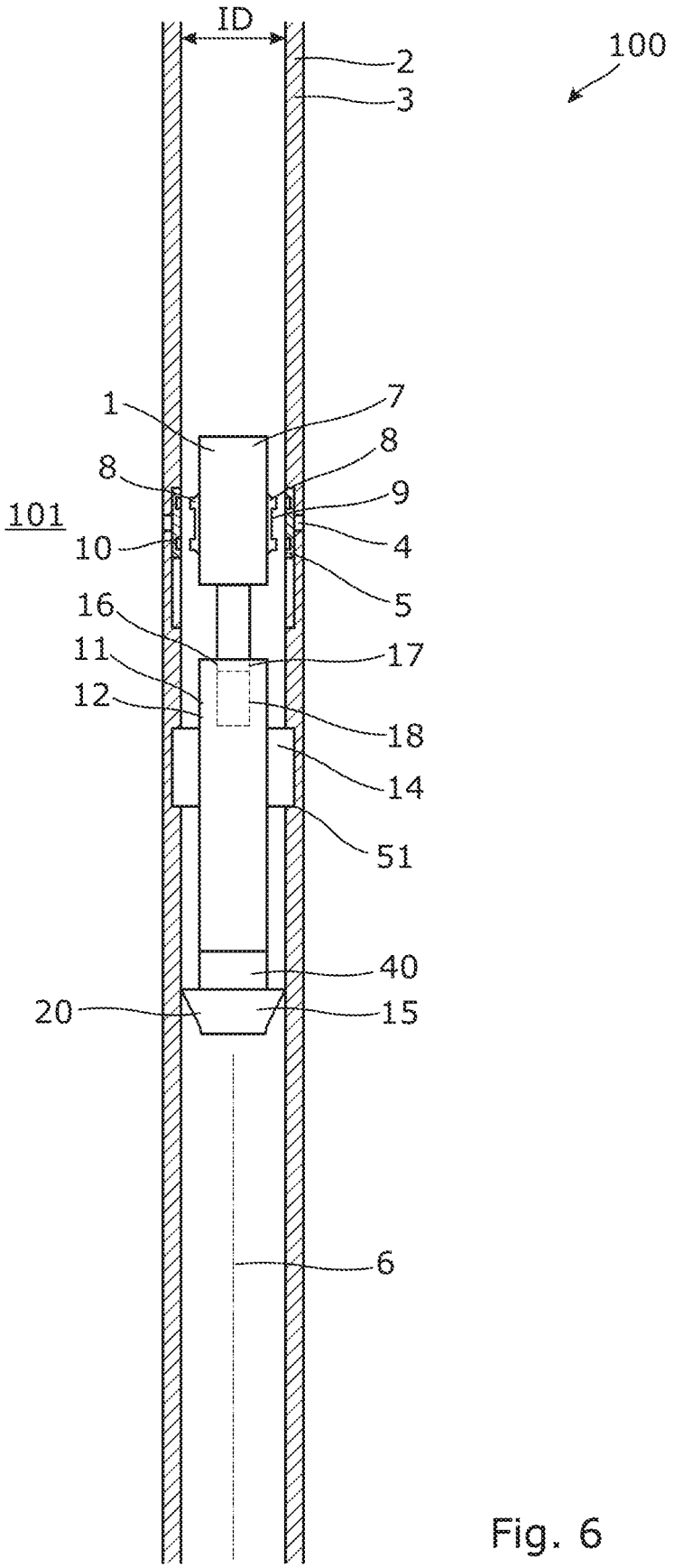
FIG. 6 shows the downhole device of FIG. 1 in which the projection elements are disengaged again.
Figure 7:
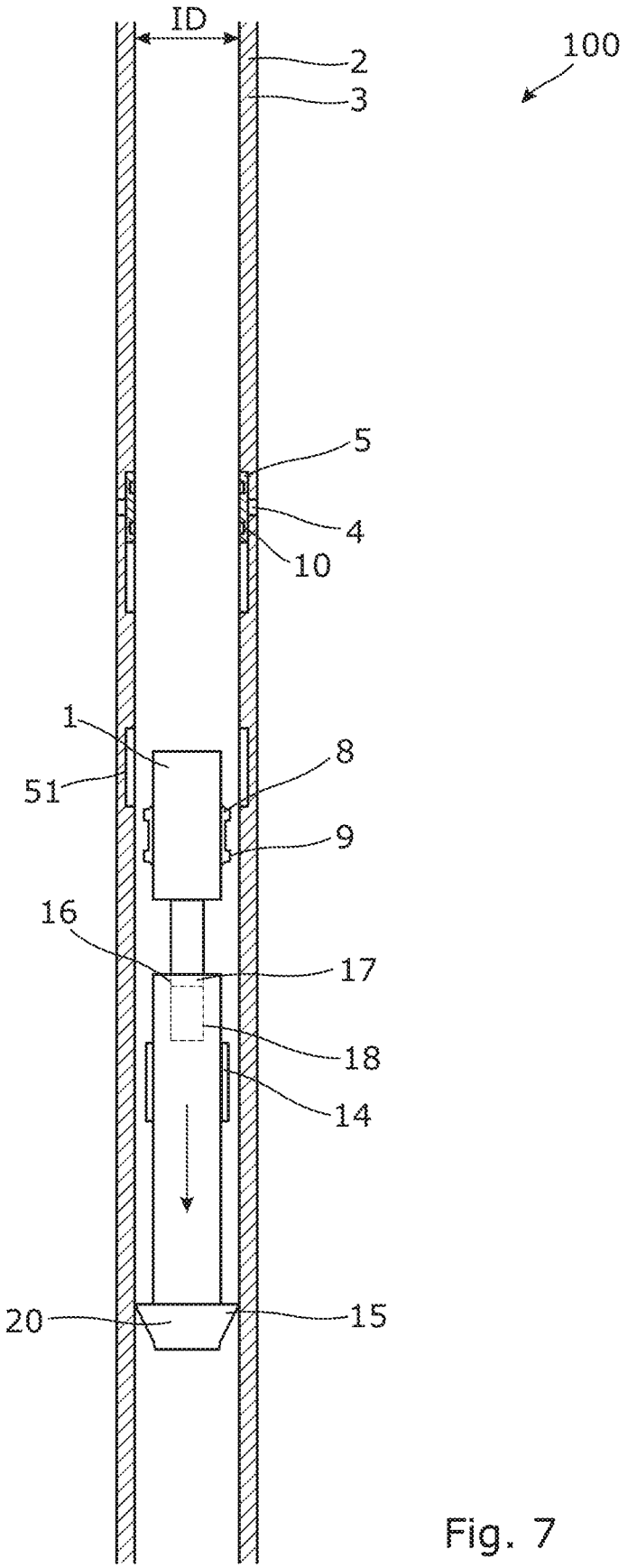
FIG. 7 shows the downhole device of FIG. 1 when moving further down the well.
Figure 10:
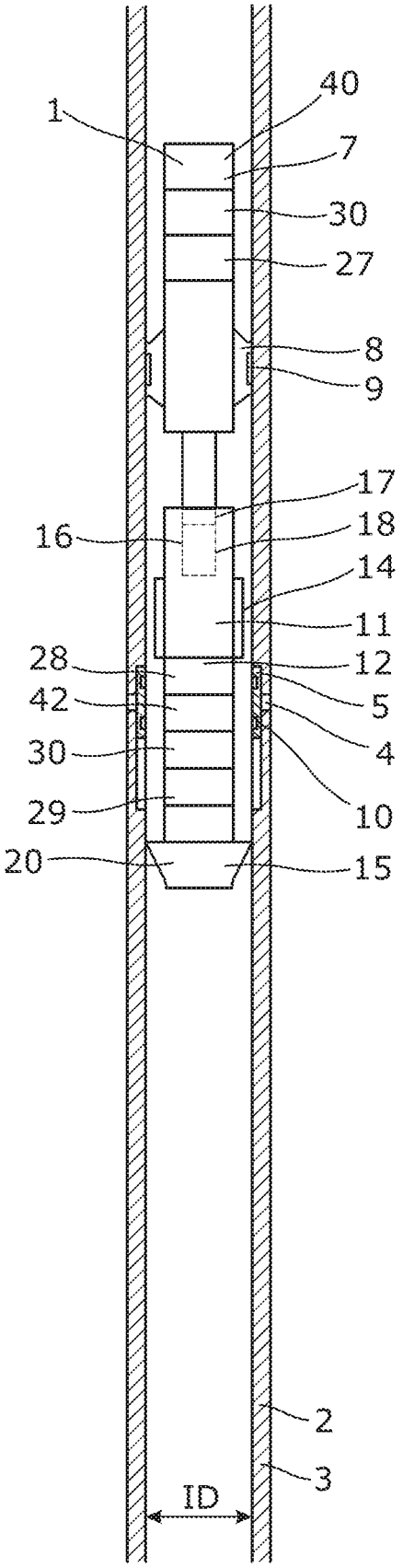
FIGS. 10-13 show a downhole device operating by firstly projecting the projection elements, and secondly by projecting the anchor elements to engage the wall of the well tubular structure.

The sealing element is a cup seal 20 and slides along an axial extension 6 of the well tubular structure having an inner diameter ID as the fluid presses onto the downhole device 1, and the cup seal helps assist the pressure in pressing the downhole device down the well tubular structure. When seated in the recess, the projection elements are positioned opposite the sleeve, and the projection elements 8 are projected, engaging the grooves in the sleeve, as shown in FIG. 3, by means of the fluid pressing onto the first part 7, thereby forcing the piston 17 into the piston cylinder 18 as the sleeve is moved downwards towards the second part 11, as shown in FIG. 4. Now, the sleeve does not cover the opening anymore, and the pressurised fluid in the well tubular structure enters through the opening 4 and into the formation to fracture or in other ways stimulate the formation in order to increase the production of hydrocarbon-containing fluid from the formation. When the stimulation process has ended, the sleeve is closed since the pressurised fluid no longer presses onto the first part 7, and the first part can then be moved away from the second part 11, e.g. by a spring 19 (shown in FIG. 8) which is compressed as the piston 17 moves into the piston cylinder 18 or by an accumulator 28 (shown in FIG. 10) accumulating the fluid which is pressed out of the piston cylinder. The sleeve 5 is thus moved to its initial closed position in which it covers the opening 4, as shown in FIG. 5, and then, the projection elements 8 are retracted, as shown in FIG. 6. Once the projection elements 8 have been retracted, the anchor elements 14 are also capable of disengaging the recess, and the downhole device moves on, as shown in FIG. 7.

Figure 8:
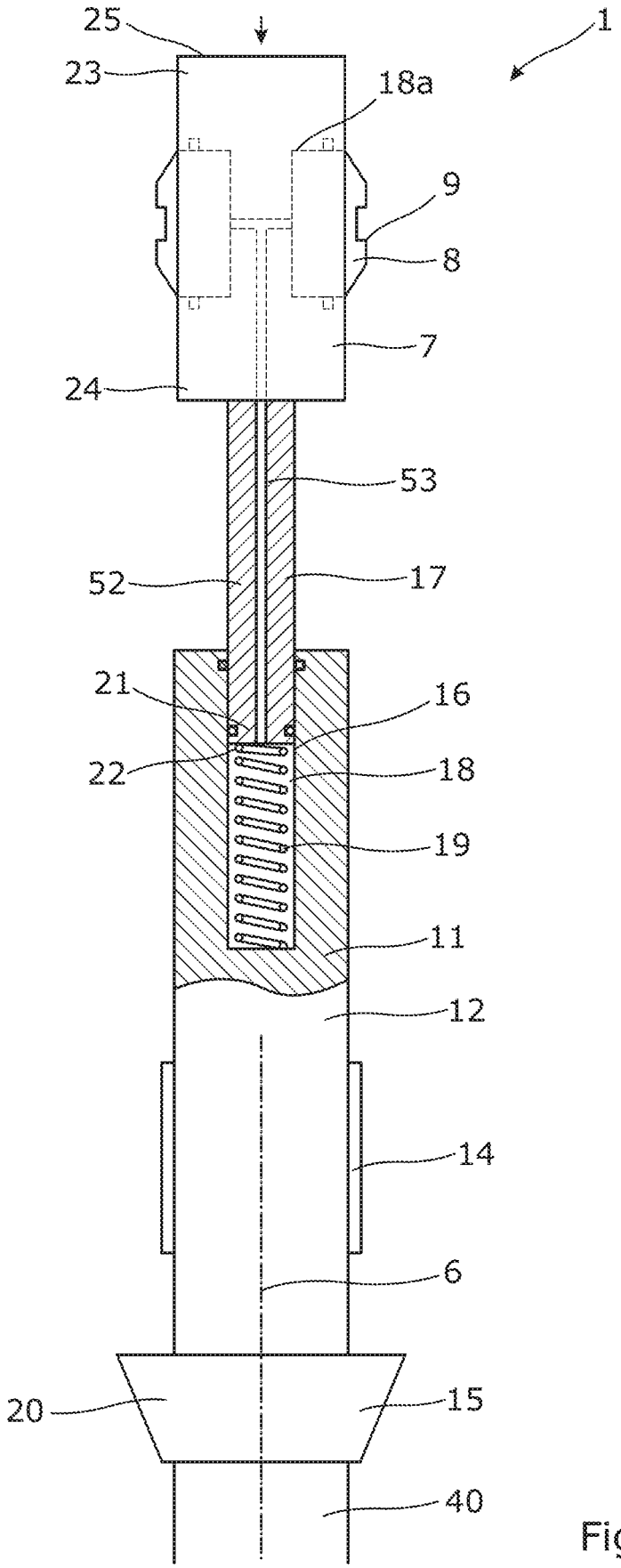
FIG. 8 shows a partially cross-sectional view of another embodiment of the downhole device.

As can be seen in FIG. 8, the first part 7 is connected with the second part by means of a shaft 52 functioning as the piston 17. As the piston 17 moves further into the piston cylinder 18, fluid from the cylinder 18 is forced through a fluid channel 53 in the piston 17, and thus the shaft 52, and into a projection cylinder 18*a* into which each projection element moves, thereby forcing the projection element radially outwards in relation to the axial extension 6 of the downhole device 1. The piston 17 has a first piston end 21 extending into the piston cylinder 18, the first piston end having a face area 22. The first part 7 has a first end 23 and a second end 24, and the second end 24 is connected to the second part 11. The first end 23 has a surface area 25 being larger than the face area 22 of the piston 17 so that pressurised fluid in the well tubular structure forces the piston 17 further into the piston cylinder 18.

Figure 9:
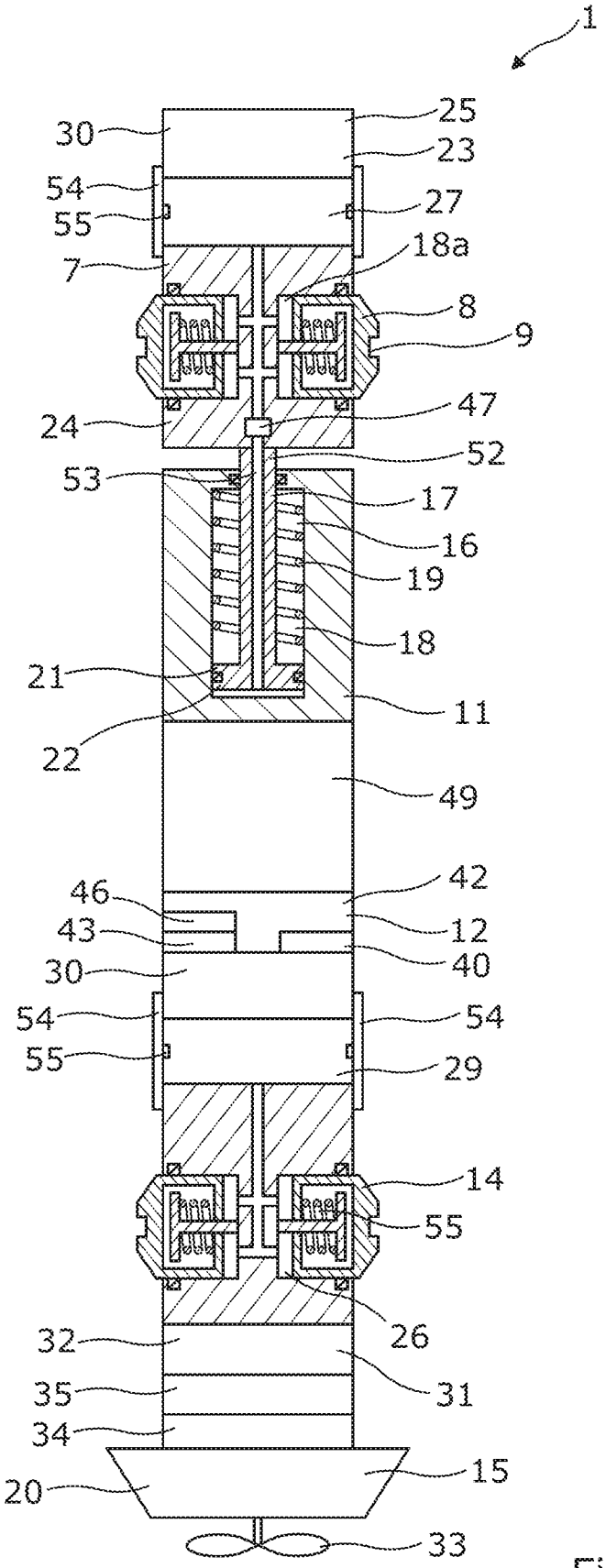
FIG. 9 shows a partially cross-sectional view of yet another embodiment of the downhole device.

In FIG. 9, each anchor element is movable in a radial direction in and out of an anchor cylinder 26 to project the anchor elements by means of a pump 29 adapted to provide pressurised fluid to the anchor cylinder 26. As the anchor elements 14 are projected, an anchor spring 55 is compressed in such a way that the spring 55 retracts the anchor elements again. A second pump 27 is arranged in the first part 7 in order to provide pressurised fluid to the projection cylinder 18*a* to project the projection elements 8. The pumps 27, 29 are driven by motors 30, and filters 54 are arranged opposite inlets in the pumps 27, 29. The downhole device further comprises a power supply 31 which comprises a battery 32 and a propeller 33 driving a turbine 34 driving a generator 35 for powering the battery as the downhole device 1 is moved up and down the well tubular structure.

The downhole device further comprises a control unit 42 configured to control the movement of the projection elements and/or the anchor elements. In FIG. 9, the anchor elements 14 are projected before reaching the sleeve to be operated. To locate the position of the downhole device in the well tubular structure, the downhole device comprises a positioning tool 40 which communicates with the control unit 42 which then activates the anchor elements 14 to be projected. When the anchor elements reach the recess, the anchor elements extend even further, and a signal is sent to the control unit activating the projection of the projection elements 8. Once the projection elements are projected, the valve 47 opens and thus allows the fluid to enter the piston cylinder 18, and thus, the movement of the piston 17 operates the sleeve in an upwards movement to uncover the opening in the well tubular structure by moving the first part 7 away from the second part 11, and the piston thereby compresses the spring 19. When the stimulation process has been performed through the opening, the pressure in the well tubular structure is released and the spring 19 retracts the piston 17 into the piston cylinder 18 and thus closes the sleeve in order that the sleeve covers the opening in the well tubular structure. The fluid in the piston cylinder flows into a compensator 49. The control unit further comprises a timer 43 which is activated, e.g. when the pressure decreases in the well tubular structure, which may be measured by a sensor, when the piston moves into the piston cylinder 18 or when the projection elements are retracted. Thus, the valve may be a sequential valve, and the control unit may further comprise a storage unit 46 for storing operational data of the performed operation and a logging tool for measuring and logging other data in the well.

Figure 14:
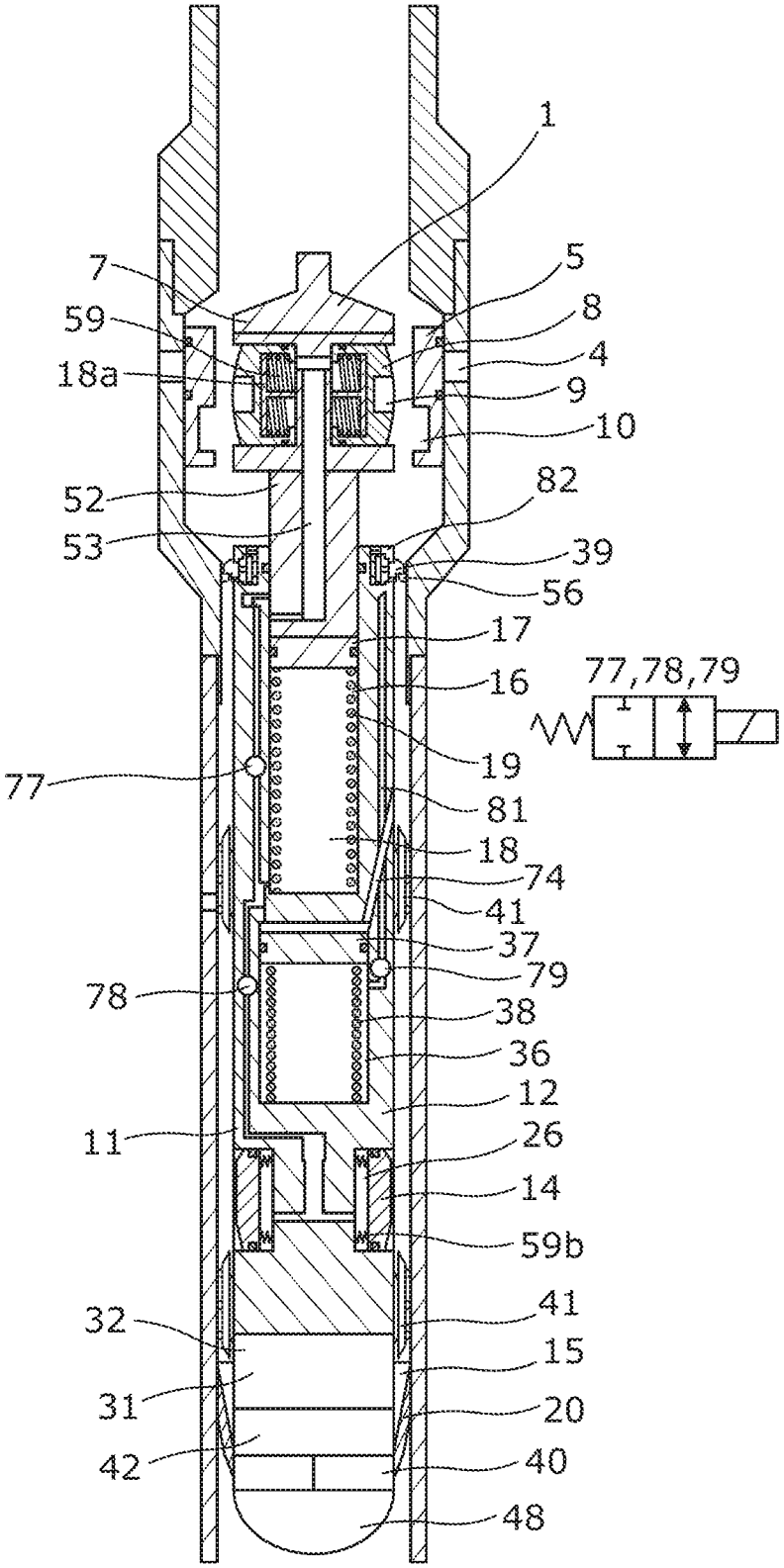
FIG. 14 shows another embodiment of the downhole device.
Figure 15:
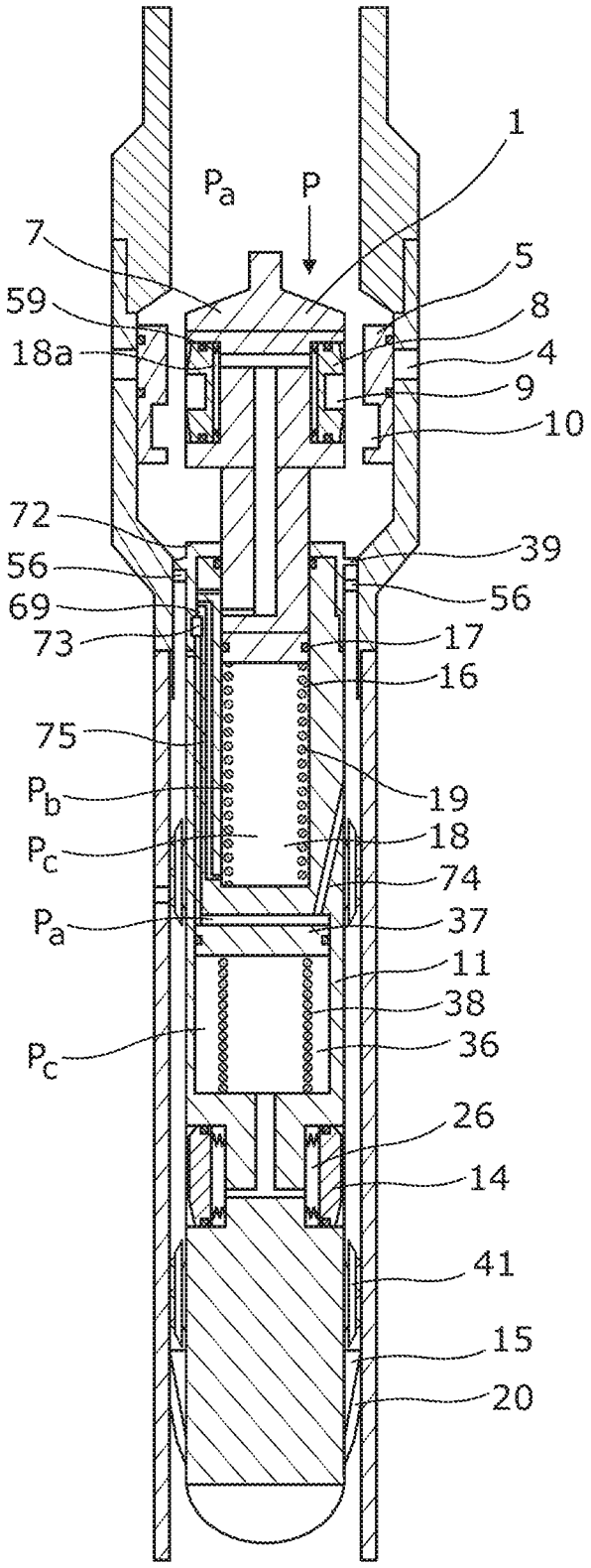
FIG. 15 shows yet another embodiment of the downhole device.

As can be seen in FIGS. 14 and 15, the downhole device may comprise an anchor activation cylinder 36 for projecting the anchor elements, instead of comprising the pump and the related motor. The anchor cylinder 26 is fluidly connected with the anchor activation cylinder 36 so that fluid having an accumulator pressure Pc in the anchor activation cylinder forces the anchor element out of the anchor cylinder upon movement of an activation piston 37 into the anchor activation cylinder 36. A second spring 38 is arranged in the anchor activation cylinder 36 in order to retract the anchor elements 14 together with third springs 59*b* in the anchor cylinder 26. The activation piston 37 is moved in the anchor activation cylinder by pressurised fluid having well pressure Pa from the well tubular structure, but it may also be moved by a pump.

In FIGS. 14 and 15, the downhole device 1 further comprises a protrusion 39 projecting radially from the body 12 of the second part 11 in order that the downhole device 1 lands on a projection 56 in the well tubular structure instead of projecting the anchor elements. In FIG. 14, the protrusion is configured to be projectable. The downhole device 1 further comprises one or more centraliser(s) 41 for centralising the downhole device 1 in the well tubular structure. The downhole device 1 has a leading end 48 which is tapered or hemisphere-shaped.

In FIG. 15, when the downhole device has landed on the projection 56, the pressure Pa in the well tubular structure is increased and the first part 7 moves towards the second part 11, and the piston 17 moves into the piston cylinder 18, thereby pressing fluid in the projection cylinder 18*a* to project the projection elements 8 and to engage the sleeve. As the piston moves further into the piston cylinder, the sleeve is moved downwards, uncovering the opening 4. At the same time, the activation piston 37 is forced downwards by the pressure in the well tubular structure, and the well fluid enters a channel 74 and presses onto the activation piston 37, thereby forcing fluid in the anchor activation cylinder 36 into the anchor cylinder 26 and into the anchor elements 8 to project and engage the well tubular structure. During stimulation, the pressure is high enough to maintain the piston in its retracted position in the piston cylinder. When the stimulation process has ended, the pressure is decreased and the spring 19 in the piston cylinder 18 forces the piston 17 to project, and the sleeve 5 is moved upwards to its closed position and the projection elements 8 are retracted. A sequence valve 73 shifts, closing the fluid communication to the projection cylinder 18*a*. Then pressure pulses are made in the well tubular structure, forcing the anchor activation piston 37 to move up and down, and a piston pin 75 connected to the piston 37 moves along a 3-slot 69 or otherwise serrated slot, and in this way, the piston pin 75 rotates the collar 72 and the protrusion 39 out of engagement with the projection 56, and the downhole device moves on to the next sleeve to be operated.

Figure 18:
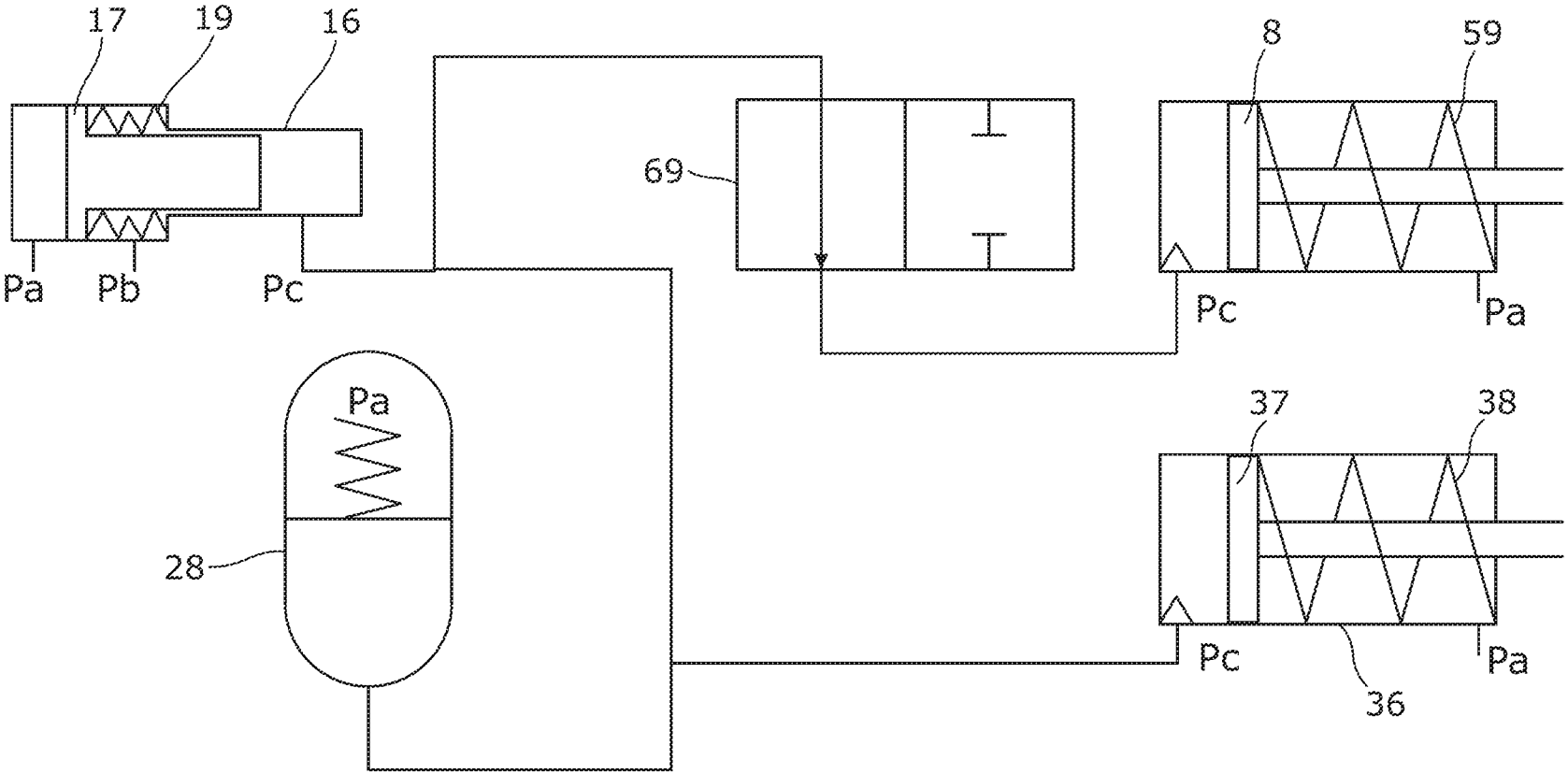
FIG. 18 shows a hydraulic diagram of the hydraulic system of the downhole device of FIG. 15.

FIG. 18 discloses a diagram of the hydraulic system of the downhole device 1 shown in FIG. 15, in which the accumulator 28 has the accumulator pressure Pc influenced by the well pressure Pa. The spring 19 has a spring pressure Pb acting on one side of the piston 17 and the well pressure on the other side of the piston 17.

In another embodiment, the pressure pulses made in the well tubular structure could force the first part 7 to move up and down in relation to the second part 11 and in the same way as the 3-slot 69 or serrated slot forces the second part 11 to rotate and forces the protrusion 39 out of engagement with the projection 56 in order that the downhole device can move on to the next sleeve to be operated.

In FIG. 14, the downhole device has a control unit 42 operating a first 77, a second 78 and a third solenoid 79 and thus operating the downhole device 1. Before the downhole device lands on the projection 56, the first solenoid 77 is closed. When the downhole device has landed on the projection 56, the first and the second solenoid are opened and the pressure in the well tubular structure is increased. Then, the first part 7 moves towards the second part 11 and moves the piston into the piston cylinder pressing fluid in the projection cylinder 18*a* to project the projection elements 8 and to engage the sleeve and compressing projection springs 59. As the piston moves further into the piston cylinder, the sleeve is moved downwards, uncovering the opening 4. At the same time, the activation piston 37 is forced downwards by the pressure in the well tubular structure, and the well fluid enters the channel 74 and presses onto the activation piston 37, thereby forcing fluid in the anchor activation cylinder 36 into the anchor cylinder 26 and into the anchor elements 8 to project and engage the well tubular structure. Then the first solenoid 77 is closed and the projection elements are released during stimulation. When the stimulation process has ended and after a certain amount of pulses, the first solenoid opens again and the pressure in the well tubular structure is increased, and the projection elements are projected and the spring 19 in the piston cylinder 18 forces the piston 17 to project, and the sleeve 5 is moved upwards to its closed position and the projection elements 8 are retracted. After a certain amount of pressure pulses in the well tubular structure, the third solenoid is opened and the pressure in the well tubular structure forces the activation piston 37 downwards, and the fluid in the activation cylinder 18 flows into a release channel 81 through the third solenoid and into a protrusion chamber 82, forcing the protrusions to retract and release the downhole device 1. The protrusions are spring-loaded in their projected position. The projection 56 can later be milled out if necessary. Furthermore, the first part 7 could have a fishing neck for retrieval of the downhole device after completion of the stimulation operation or in the event that the downhole device gets stuck.

In FIG. 14, the downhole device could also be operated in order that the projection elements engage the sleeve and hold the sleeve in its open position during the stimulation in the same way as described above.

Figure 17:
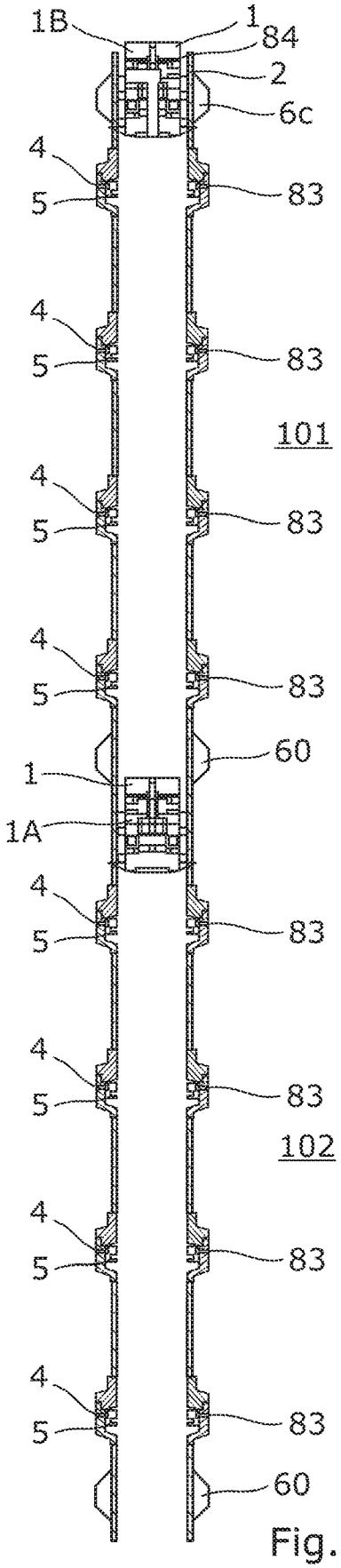
FIG. 17 shows a partially cross-sectional view of yet another downhole system.

In FIG. 17, a first downhole device 1, 1A and a second downhole device 1, 1B are used to operate four sleeves 5 in a first production zone 101 between two annular barriers 60 at a time. First, the first downhole device 1, 1A is submerged, and when moving past the sleeves, all four sleeves 5 in the first production zone 101 are opened, thereby uncovering the openings 4 in which burst discs 83 are arranged. Then, after a certain pressure level is reached, the burst discs 83 burst and the stimulation process can begin. Subsequently, the second downhole device 1, 1B follows, passing each of the opened sleeves 5, and closes each sleeve before the first downhole device 1, 1A begins to open the sleeves 5 in the second production zone 102. The second downhole device 1, 1B has a bypass channel 84 through which the pressurised fluid for bursting the discs and/or the stimulation fluid can pass. Once the second downhole device 1, 1B needs to move downwards to close the sleeves, the bypass channel 84 is closed, e.g. by pulling a slickline connected to the second downhole device 1, 1B or by means of a timer. Subsequently, the bypass channel 84 is opened again, also by pulling the slickline (if any) or by using a timer.

Figure 11:
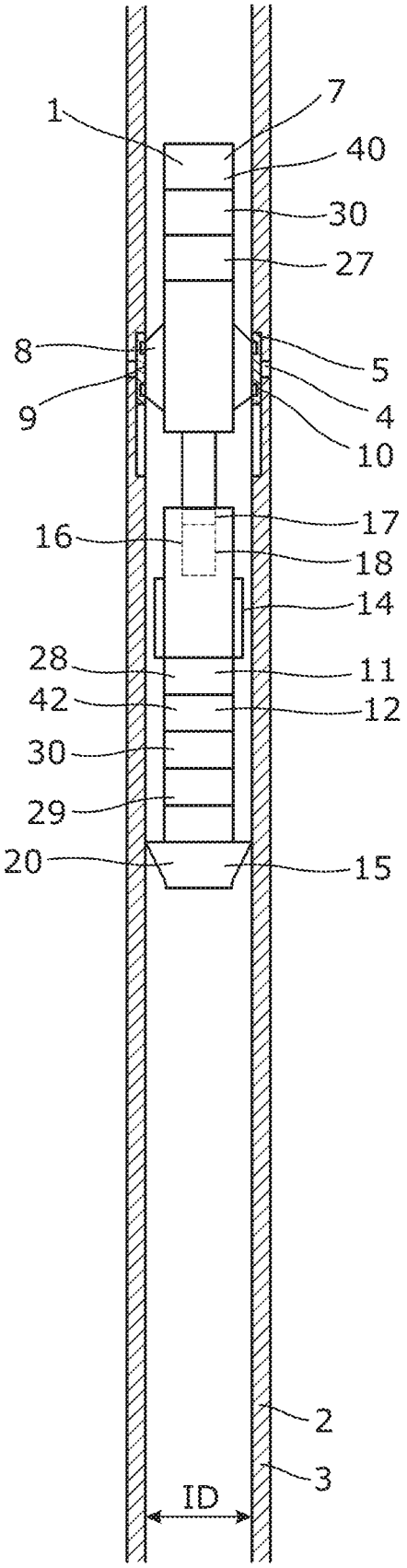
Figure 12:
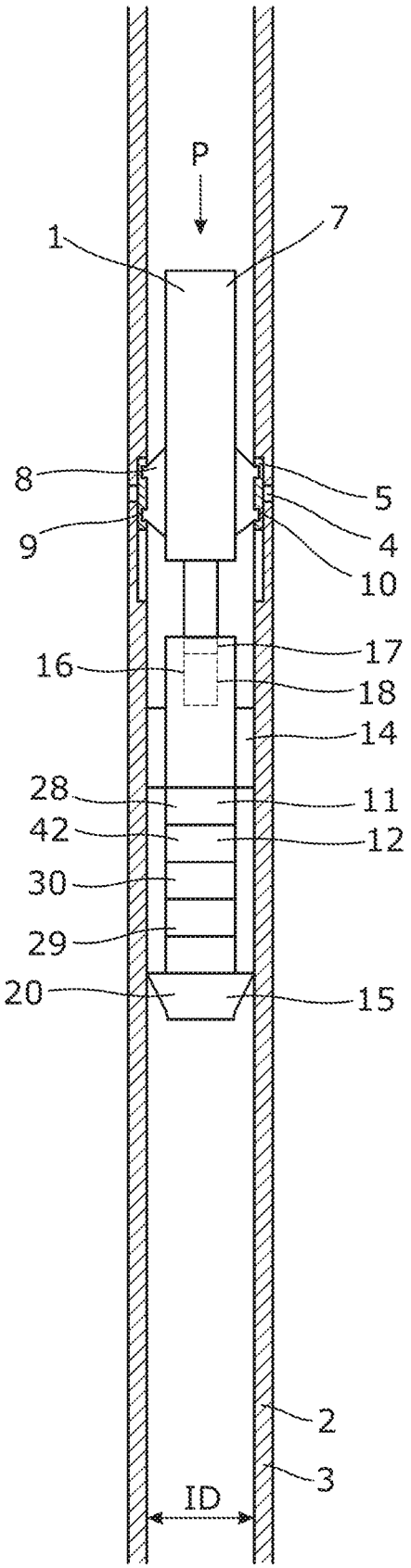
Figure 13:
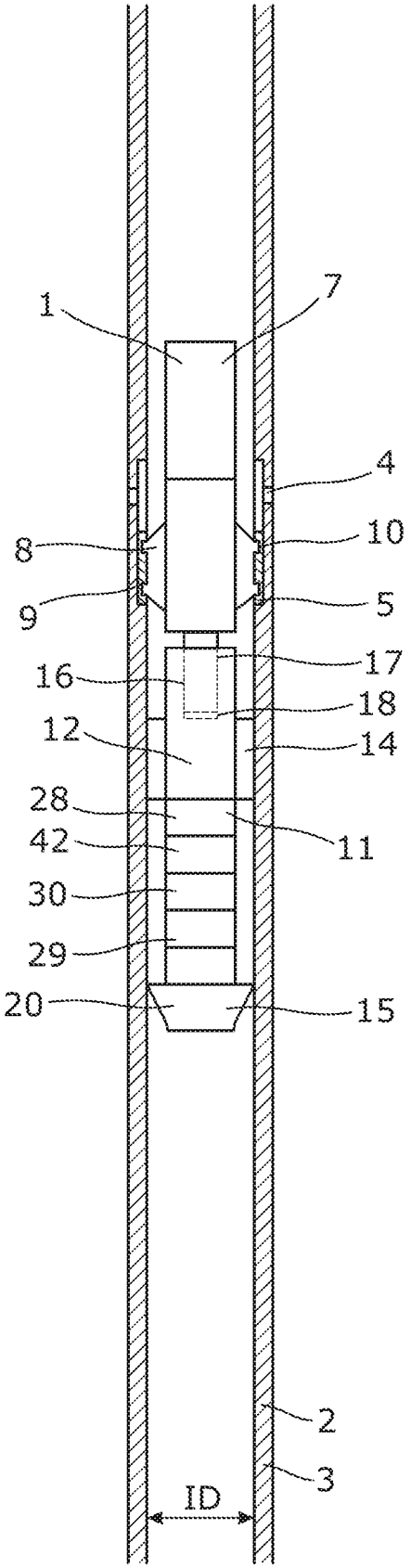

In FIGS. 10-13, the downhole device is operated in a different manner than in FIGS. 1-8. In FIGS. 10-13, the downhole device projects the projection elements 8 when approaching the sleeve 5 to be operated. The projection elements 8 are projected by means of the pump 27 driven by the motor 30, which is also shown in FIG. 9. The projection elements 8 slide in their projected position along the well tubular structure until the projection elements 8 reach the grooves 10 in the sleeve 5, and then, they further project into engagement with the grooves, as shown in FIG. 11. Once the engagement with the sleeve is detected, the anchor elements are also projected by means of the pump 29. The anchor elements abut the inner face of the well tubular structure when projected, and they fixate the second part 11 by means of friction therebetween. Thus, in this embodiment, the well tubular structure does not need to have a recess for the downhole device in order to function. After projection of the anchor elements 14, the pressure P (shown in FIG. 12) in the well tubular structure activates the displacement mechanism 16 and the piston 17 moves into the piston cylinder 18, forcing the sleeve 5 from a closed position to an open position, uncovering the opening 4, as shown in FIG. 13, and thus the stimulation operation can begin. When the stimulation operation has ended, the first part 7 is moved away from the second part 11, closing the sleeve, and the projection elements and the anchor elements are retracted and the downhole device moves further down the well tubular structure.

Figure 16:
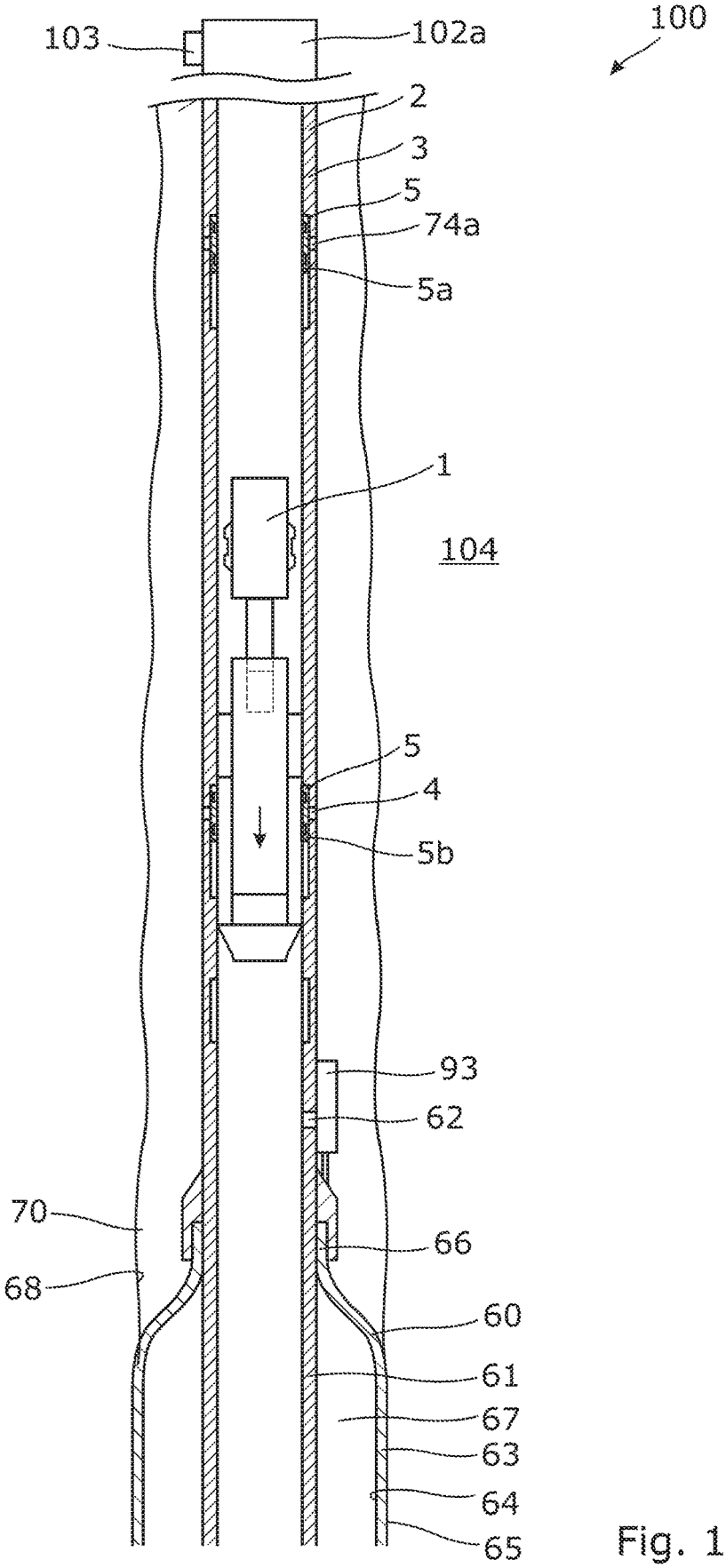
FIG. 16 shows a partially cross-sectional view of another downhole system.

FIG. 16 shows a downhole system 100 for stimulating a formation surrounding a well tubular structure 3 of a well 2 in which the downhole device is used. The well has a top 102*a*, and a system pump 103 is arranged at the top to pressurise the well tubular structure. The downhole system 100 comprises the well tubular structure 3 which has at least two openings 4 for allowing fluid to flow into and/or out of the well tubular structure and a first movable sleeve 5, 5*a* and a second movable sleeve 5, 5*b*. Each movable sleeve is arranged opposite one of the openings, and when in a first position, the sleeves cover the openings 4, and when in a second position, the sleeves uncover the openings 4. A system pump 103 is configured to pressurise the well tubular structure. The downhole system 100 further comprises an annular barrier 60, preferably both a first and a second annular barrier, configured to isolate a zone 104 to be stimulated. Each barrier comprises a base tubular part 61 for being mounted as part of the well tubular structure 3, the base tubular part 61 comprising an aperture 62, and the annular barrier further comprises an expandable sleeve 63 surrounding the base tubular part. The expandable sleeve 63 has an inner face 64 facing the base tubular part 61 and an outer face 65 facing a wall 68 of a borehole 70. Each end 66 of the expandable sleeve is connected with the base tubular part, thereby defining an annular space 67 between the inner face of the expandable sleeve and the base tubular part. When the downhole device is positioned opposite the second sleeve 5*b*, the aperture 62 of the base tubular part is arranged closer to the top of the well than the sealing element of the downhole device 1. The annular barrier further comprises an expansion and anti-collapse unit 93.

As can be seen, the first movable sleeve is arranged opposite a production opening 74*a* in an inflow section of the well tubular structure 3. The production opening 74*a* may have a production valve.

A stimulation method for stimulating a formation by means of a downhole system comprises the steps of submerging the downhole device in the well tubular structure and pressurising the well tubular structure. Furthermore, the downhole device moves along the well tubular structure and positions the first part of the downhole device opposite the first movable sleeve. Then, engagement of the groove of the first movable sleeve by means of the projection element occurs, and the anchor elements are anchored in the well tubular structure. Also, the first part moves in relation to the second part in a first direction, and thereby, the first movable sleeve uncovers the opening, and the formation is stimulated by injecting fluid out of the opening and moves the first part in relation to the second part in a second direction opposite the first direction, thereby closing the opening. Then, the projection elements and the anchor elements release and the downhole device moves along the tubular structure and positions the first part of the downhole device opposite the second movable sleeve. Subsequently, the downhole device engages the groove of the second movable sleeve by means of the projecting element.

The movement of the first part in relation to the second part can also be initiated by pressurised fluid which presses the first part towards the second part in the first direction, and where the first part is moved away from the second part by using a compressed spring. The movement of the first part in relation to the second part compresses a spring.

By fluid or well fluid is meant any kind of fluid that may be present in oil or gas wells downhole, such as natural gas, oil, oil mud, crude oil, water, etc. By gas is meant any kind of gas composition present in a well, completion, or open hole, and by oil is meant any kind of oil composition, such as crude oil, an oil-containing fluid, etc. Gas, oil, and water fluids may thus all comprise other elements or substances than gas, oil, and/or water, respectively.

By a casing, production casing or well tubular structure is meant any kind of pipe, tubing, tubular, liner, string etc. used downhole in relation to oil or natural gas production.

In the event that the tool is not submergible all the way into the casing or that the downhole device is stuck, a downhole tractor can be used to retract the downhole device from the well. The downhole tractor may have projectable arms having wheels, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole device for being moved downwards in a well by fluid to assist stimulation of a production zone of the well, the well comprising a well tubular structure having a first opening and a first movable sleeve arranged opposite the first opening, the well tubular structure having an inner diameter, the downhole device having an axial extension and comprising:

a first part comprising:

two projection elements having a profile matching grooves in the sleeve, and a second part comprising:

a body, two anchor elements projectable from the body for anchoring the second part in the well tubular structure, and a sealing element configured to seal against the well tubular structure, the sealing element being spaced from and, in use, positioned downhole from the two anchor elements, wherein the downhole device further comprises a displacement mechanism comprising a piston movable within a piston cylinder to displace, in the axial extension, the first part in relation to the second part when the two anchor elements are anchored in the well tubular structure and the two projection elements are engaged with the grooves in the sleeve to operate the sleeve.

2. A downhole device according to claim 1, wherein the displacement mechanism further comprises a spring being compressed during movement of the piston in relation to the piston cylinder.

3. A downhole device according to claim 1, wherein the sealing element is a cup seal.

4. A downhole device according to claim 1, wherein each projection element is movable in a radial direction in and out of a projection cylinder.

5. A downhole device according to claim 4, wherein the projection cylinder is fluidly connected with the piston cylinder so that fluid in the piston cylinder forces the projection element out of the projection cylinder upon movement of the piston into the piston cylinder.

6. A downhole device according to claim 4, wherein the piston has a first piston end extending into the piston cylinder, the first piston end having a face area, and the first part has a first end and a second end being connected to the second part, and the first end has a surface area being larger than the face area of the piston so that pressurised fluid in the well tubular structure forces the piston further into the piston cylinder.

7. A downhole device according to claim 4, wherein each anchor element is movable in a radial direction in and out of an anchor cylinder.

8. A downhole device according to claim 7, further comprising an anchor activation cylinder, the anchor cylinder being fluidly connected with the anchor activation cylinder so that fluid in the anchor activation cylinder forces the anchor element out of the anchor cylinder upon movement of an activation piston into the anchor activation cylinder.

9. A downhole device according to claim 1, further comprising a pump adapted to provide pressurised fluid to the anchor cylinder and/or the projection cylinder to project the anchor elements and/or projection elements, respectively.

10. A downhole device according to claim 1, wherein the second part further comprises a protrusion projecting radially from the body.

11. A downhole device according to claim 1, further comprising a positioning tool configured to determine a position of the downhole device along the well tubular structure.

12. A downhole device according to claim 1, further comprising a control unit configured to control the movement of the projection elements and/or the anchor elements.

13. A downhole device according to claim 1, wherein the well tubular structure includes at least one recess to receive the two anchoring elements.

14. A downhole system for stimulating a formation surrounding a well tubular structure of a well, the well having a top, comprising:

a well tubular structure comprising:

at least two openings for allowing fluid to flow into and/or out of the well tubular structure, at least a first movable sleeve and a second movable sleeve, each movable sleeve being arranged opposite one of the openings in a first position and uncovering the openings in a second position, and each movable sleeve having at least one groove, a system pump configured to pressurise the well tubular structure, and a downhole device according to claim 1.

15. A stimulation method for stimulating a formation by means of a downhole system according to claim 14, comprising:

submerging the downhole device in the well tubular structure, pressurising the well tubular structure, moving the downhole device along the well tubular structure, positioning the first part of the downhole device opposite the first movable sleeve, engaging the groove of the first movable sleeve by means of a projection element, anchoring the anchor elements in the well tubular structure, moving the first part in relation to the second part in a first direction, the first movable sleeve thereby uncovering the opening, stimulating the formation by injecting fluid out of the opening, moving the first part in relation to the second part in a second direction opposite the first direction, thereby closing the opening, releasing the projection elements and anchor elements, moving the downhole device along the well tubular structure, positioning the first part of the downhole device opposite the second movable sleeve, and engaging the groove of the second movable sleeve by means of the projecting element.

16. A stimulation method according to claim 15, wherein moving the first part in relation to the second part is performed by pressurised fluid pressing the first part towards the second part in the first direction.

* * * * *